United States Patent [19]

Daniels et al.

[11] Patent Number: 5,035,323

[45] Date of Patent: Jul. 30, 1991

[54] SHIPPER DISPLAY

[75] Inventors: Thomas C. Daniels, Bradenton; Patricia M. Jeruzal; Griscom Bettle, III, both of Sarasota, all of Fla.

[73] Assignee: Tropicana Products, Inc., Bradenton, Fla.

[21] Appl. No.: 487,318

[22] Filed: Mar. 2, 1990

[51] Int. Cl.[5] ..... B65D 19/00

[52] U.S. Cl. ..... 206/386; 206/503; 206/432; 206/597; 206/429; 206/459

[58] Field of Search ..... 206/459, 429, 597, 432, 206/503, 386, 431, 194, 199, 139, 821, 504

[56] References Cited

U.S. PATENT DOCUMENTS

| | | | |
|---|---|---|---|
| 2,828,047 | 3/1958 | Weiselbeng | 206/194 X |
| 2,919,844 | 1/1960 | Anderson, Jr. | 206/194 X |
| 3,598,302 | 8/1971 | Nowak | 206/429 |
| 3,752,310 | 8/1973 | Higgin | 206/504 X |
| 3,949,930 | 4/1976 | Giordano | 206/139 X |
| 3,991,880 | 11/1976 | Austrins et al. | 206/431 |
| 4,292,901 | 10/1981 | Cox | 206/597 X |
| 4,567,981 | 2/1986 | Headon | 206/429 X |
| 4,615,443 | 10/1986 | Deffner et al. | 206/503 X |

FOREIGN PATENT DOCUMENTS

| | | | |
|---|---|---|---|
| 1546085 | 10/1968 | France | 206/432 |
| 2185461 | 7/1987 | United Kingdom | 206/821 |

*Primary Examiner*—William I. Price

*Attorney, Agent, or Firm*—Blum Kaplan

[57] ABSTRACT

This disclosure relates to a shipper display providing for construction and system for shipping and displaying a rigid container. The shipper display includes a plurality of base cartons for receiving the containers while leaving a substantial portion of the length thereof exposed. Stacks of filled base cartons are supported on a pallet and covered by a top carton which couples to the top of the containers. The assembly is joined for shipping by strappings and stretch wrap, or by a shrink bag, which, together with the top carton, are removed for display. The container may be formed with spaced indented regions which cooperate with tabs in the base carton to help hold the containers in place.

36 Claims, 6 Drawing Sheets

FIG. 4
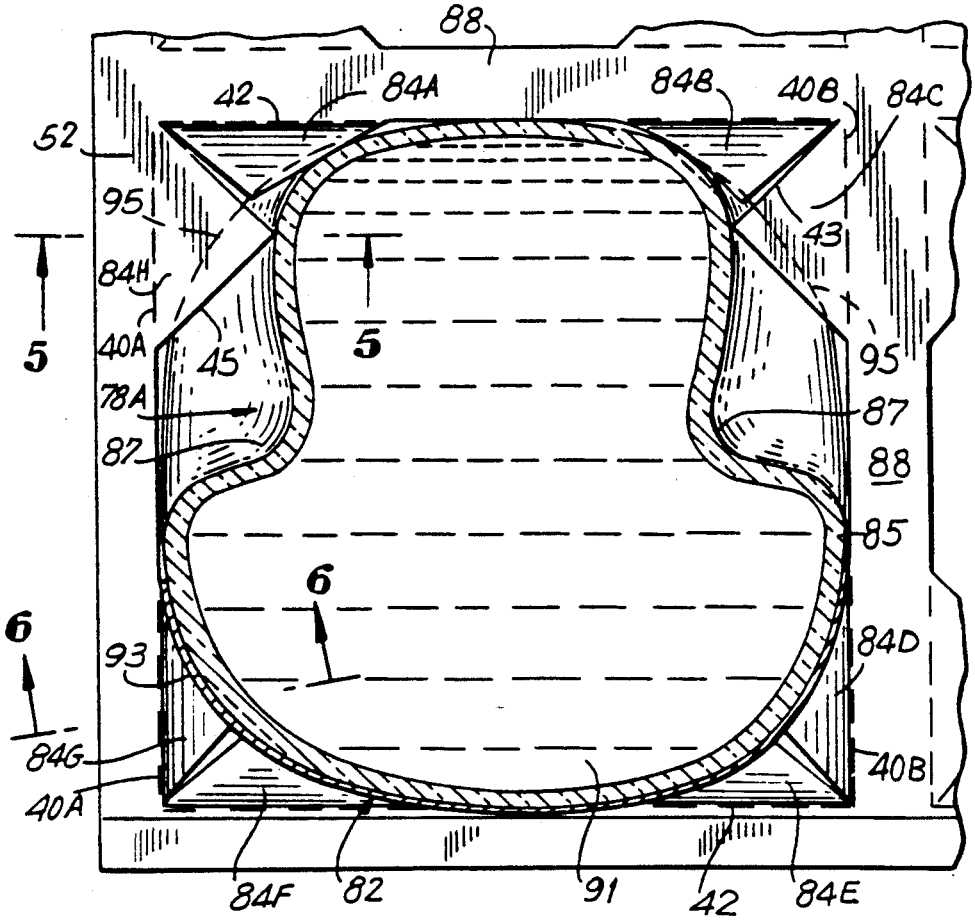
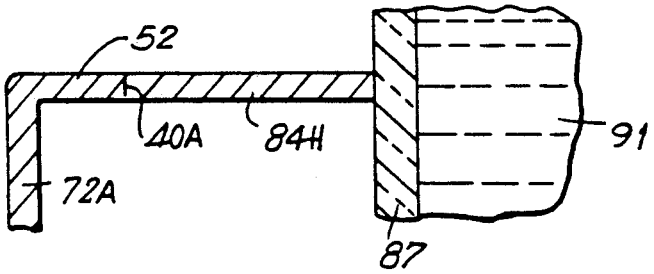
FIG. 5
FIG. 6
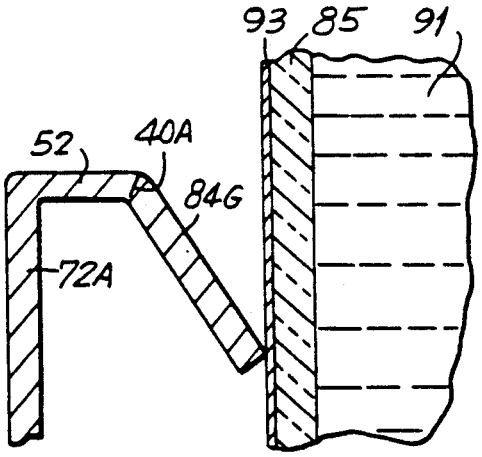

SHIPPER DISPLAY

BACKGROUND OF THE INVENTION

This invention generally relates to a construction and method for shipping products in a manner permitting efficient and safe and ready display in the store using the shipping materials. In particular, this invention enables the manufacturer to ship its product in a sturdy and durable manner on a pallet while permitting the retailer to display the product for sale on the floor of a grocery or other retail store without the need for disturbing or removing the product from its basic shipping materials.

It is known in the art how to ship a product in a sturdy and rigid fashion. It also known in the art how to create a store display by stacking cartons and even to permit cutting of shipping cartons to create point-of-sale individual displays. The advantage of that arrangement is convenience to the retailer and positioning of products in preferred positions in aisles or at the end of aisles rather than on shelves.

However, a construction permitting individual shipping and display on a pallet basis of a plurality of cartons with a minimum of manipulation, and particularly adapted for liquid products provided in rigid containers such as glass containers, has not been heretofore provided and is deemed of outstanding commercial advantage.

SUMMARY OF THE INVENTION

Generally speaking, in accordance with the invention, there is provided a construction and method for shipping and displaying rigid containers by using a plurality of base cartons of a height less than the height of the containers. Each base carton is formed with a plurality of holding regions each shaped to receive and retain a lower portion of a container, positioning the containers in spaced relation and a flat bottom surface suitable for support by the tops of a group of containers themselves contained in a base carton. At least one top carton overlies an upper region of at least a portion of the containers in the uppermost of a stack of filled base containers. The top carton is of a height less than the height of the container and is adapted to engage the upper portions of the containers.

The base cartons are each preferably formed of a blank having fold lines and cuts. The blank is manipulated along the fold lines and cuts to form an essentially rectangular base carton of a height selected to permit viewing of at least a portion of the containers supported thereby, and even a portion of the product identification information on the containers. A plurality of the base cartons, once formed and loaded, are placed on a pallet in a specified configuration. In the preferred embodiment the formation is $3 \times 4$, three base cartons lengthwise, four base cartons widthwise.

Once the first layer of base cartons and containers is formed, a corrugated board sheet may be placed on top of the layer and a second layer of loaded base cartons are applied in a like or different array. The process is repeated until the desired height is reached. In a preferred embodiment, five layers of loaded base cartons is the desired height. A number of top cartons sufficient to cover the entire top layer is then position on the top layer. The top cartons are each formed by a lid portion containing a bottom and four downwardly facing sides receiving an insert portion containing four upwardly facing sides and a bottom containing holes positioned to receive the top region of the bottles. Each top carton is preferably dimensioned to cover and engage the cartons on more than one base carton. In a preferred embodiment two top cartons are provided, each covering the containers in six base cartons.

To further support and steady the product for shipping, corner pieces preferably made of corrugated board are added to the tops and sides to lock the cases in place. Straps are then wrapped around the entire display and pallet to form a shippable unit. A pallet base decorative strip suitable for covering the periphery of the pallet and containing advertising material may be retained by the straps or a wrapping material for shipping and eventual removal and application when the product is displayed in the retail store. Finally, plastic stretch wrap is used to wrap the assembled shipper display to protect the product containers from contamination and pilfering and to aid in holding the assembly together during shipping and transportation. In an alternative embodiment, corner pieces and straps may be dispensed with and replaced by a plastic container dimensioned to capture the assembled top cartons, base cartons, containers and pallet when shrunk into engagement therewith.

The containers are formed preferably with indented regions above the bottoms, the holding regions of the base cartons including deflectable tabs positioned to be displaced by the lower region of the container during insert and to engage in the indented regions of the container to retain the container. The holding regions are each preferably formed with a symmetrical array of displaceable tabs greater in number than the number of indented regions on the container. While the indented regions are not symmetrically positioned, the tabs permit the container to be retained without regard to the orientation of the container in the holding region.

Accordingly, it is an object of this invention to provide a construction for the steady and sturdy shipping of a product.

Another object of the invention is to provide a method and construction for shipping rigid product containers in several layers on a pallet and transforming the shipping materials into a display unit without the need to remove the product from the pallet or to cut open cartons, and with minimum manipulation.

A further object of the invention is to provide a shipping construction and method using minimum materials which exposes the product labels during shipping and display and permits display and shipping on a pallet without removal therefrom.

Still other objects and advantages of the invention will, in part, be obvious and will, in part be apparent from the specification.

The invention accordingly comprises an article of manufacture possessing the features, properties, and the relation of elements which will be exemplified in the article hereinafter described, and the scope of the invention will be indicated in the

BRIEF DESCRIPTION OF THE DRAWINGS

For a fuller understanding of the invention, reference is had to the following description taken in connection with the accompanying drawings, in which:

FIG. 4 is a fragmentary plan view of a holding region a base carton in accordance with the invention;

FIG. 5 and 6 are fragmentary views of the carton taken along the lines 5-5 and 6-6, respectively of FIG. 4;

DESCRIPTION OF THE PREFERRED EMBODIMENTS

Figure 1:
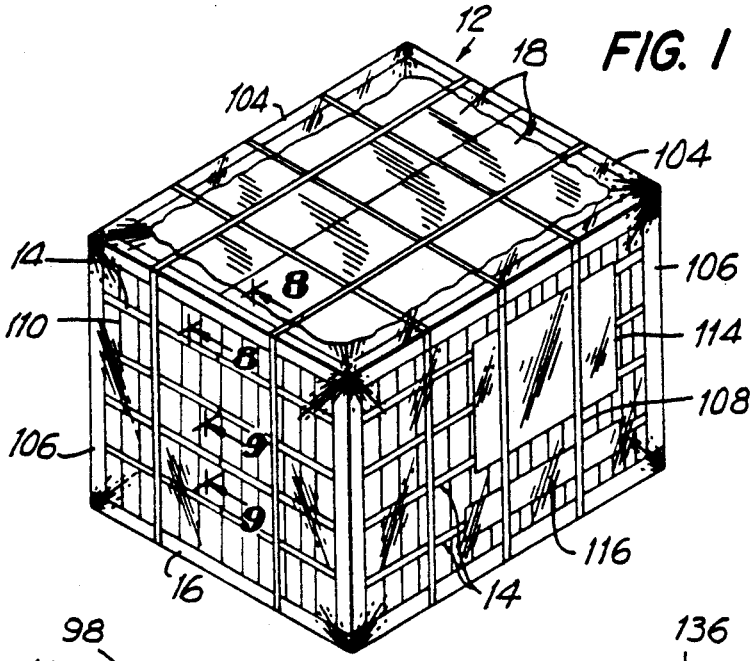
FIG. 1 is a perspective view of the shipper display in accordance with the invention.
Figure 2:
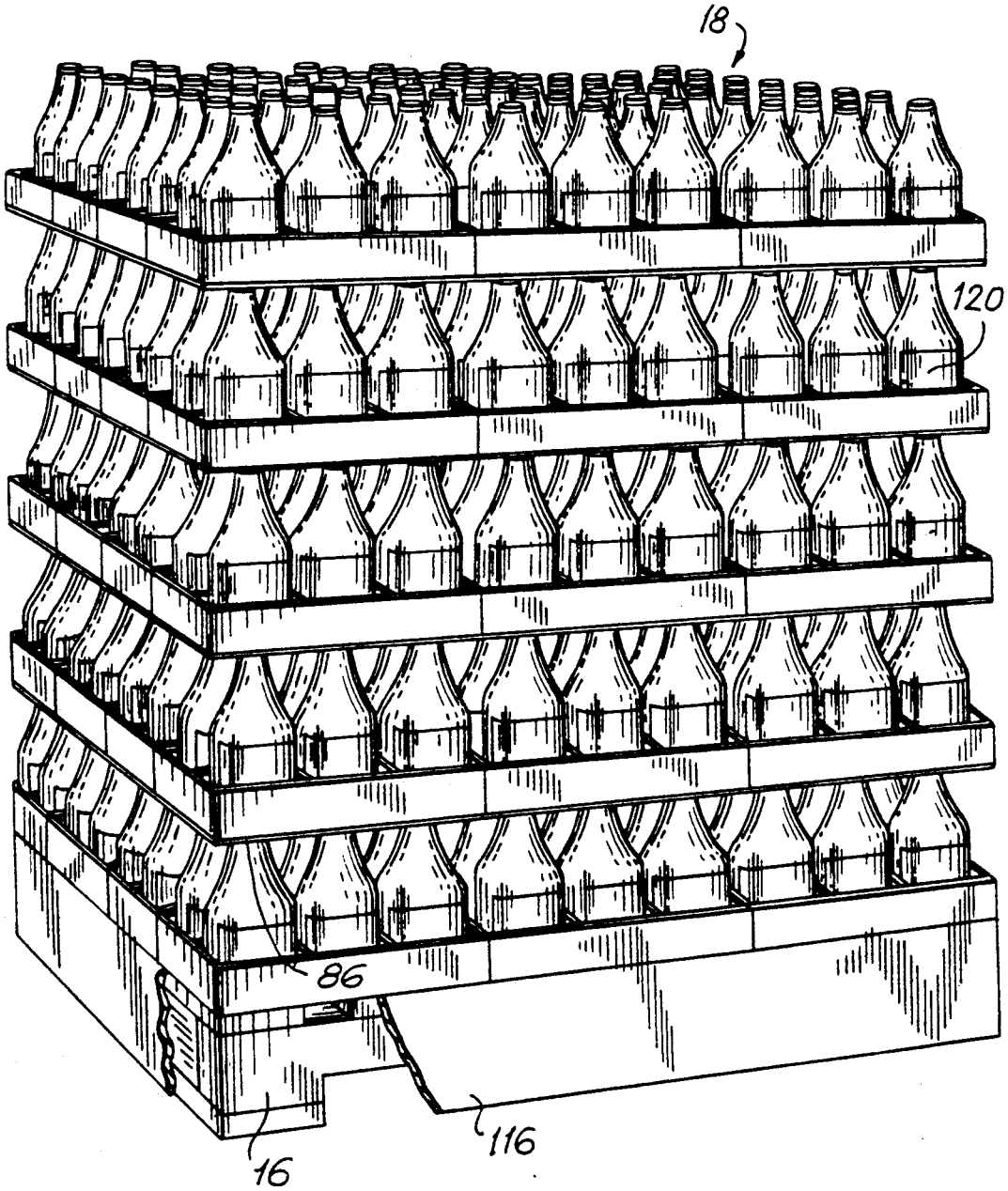
FIG. 2 is a perspective view of the shipper display in accordance with the invention in the display configuration.

Referring now to the drawings in detail, it will seen that there is illustrated in FIG. 1 through 8 a shipper display which is formed in accordance with the invention, the shipper display being generally referred to in FIG. 1 by the reference numeral 12. As more particularly seen in FIGS. 1 and 2, the base of the shipper display is a pallet 16 of conventional construction, preferably formed of wood. A plurality of base cartons 14, each carrying six rigid bottle containers 82, are stacked on the pallet in a solid three base carton by four base carton array. Five layers of said three by four base carton arrays are stacked one upon another with flat sheets of corrugated board 86 between each layer (FIGS. 2 and 9). Two top cartons 18 are laid on top of the top layer of containers 82, each top carton mating with the tops 112 of containers 82.

Four top corner protectors 104 are positioned along each of the horizontally extending top corner edges defined by the two side-by-side top boxes. The top corner protectors 104 and the entire assembly of pallet 16, base cartons 14, containers 82, top cartons 18 and corrugated boards 86 are held together by strapping material 108 preferably formed of a plastic material. Side corner protectors 106 are mounted on each of the four vertically extending edges defined by the stacks of base cartons 14 and are held in place by protective plastic stretch wrap material 110 extending at least about the four vertical sides of the assembled shipper display as more particularly shown in FIGS. 1, 8 and 9. Also captured and retained by the plastic stretch wrap material 110 can be a point-of-sale poster 114 and a folded pallet base decorative strip 116 (FIG. 1).

The assembled shipper display 12 can be stored and shipped as a unit, each unit including 360 containers in the example depicted. The shipper display 12 can be positioned in a retail establishment at a preferred position at the end of an aisle or in an aisle and readily agreed by the retailer to present the product bearing containers for display and sale.

Specifically, the stretch wrap material 110 and straps 108 are readily cut away and the top corner protectors 104, side corner protectors 106 and top cartons 18 are removed and discarded to expose the top layer of containers for removal by customers.

As more particularly shown in FIG. 2, the pallet base decorating strip is unfolded and secured to the periphery of the wooden pallet, as by staples. The result is both more decorative and provides a surface suitable for promotional material such as repetitions of the trademark and product description. The outer periphery of each base carton 14 can be similarly decorated. Further, as more particularly shown in FIG. 2, a large portion of each layer of the containers 82 and the labels 120 thereof are visible between the spaced base cartons, providing an effective and eye-pleasing display When the top layer of containers are removed, or as each base carton 14 is emptied, the base carton of the top layer can be removed and discarded. When an entire layer is removed, the protective corrugated board 86 above the next layer is removed and discarded. When the pallet is entirely empty, it can be removed and discarded or recycled. In any event, the location is available for the next shipper display !2.

Figure 3:
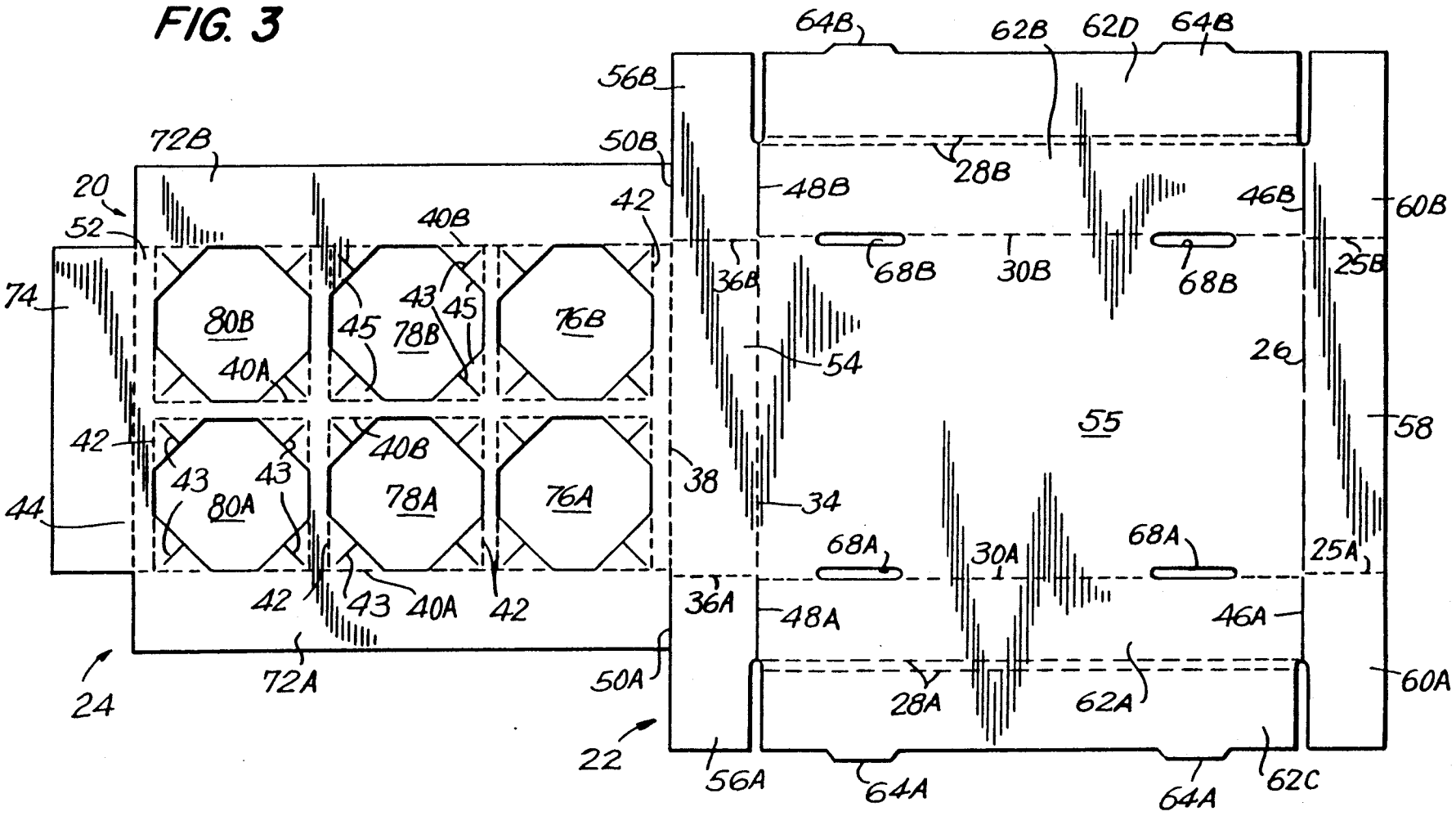
FIG. 3 is a top plan view of a base carton blank in accordance with the invention having identified slots, fold lines, cuts and tabs.

Referring now particularly to FIG. 3, illustrated is a blank, generally identified by the reference numeral 20, from which a base carton 14 is formed. The carton blank 20 is preferably formed of corrugated sheet material provided with a suitable decorative external coating to display information or trademarks for the product, preferably on side wall panels 54, 58, 62A and 62B. The corrugated sheet material is preferred because of its ability to support the weight of the containers 82.

The blank 20 is defined by an outer essentially rectangular portion 22 and an inner essentially rectangular portion 24. The blank 20 contains a plurality of fold lines 26, 28A, 28B, 30A, 30B, 34, 36A, 36B, 38, 40A, 40B, 42 and 44 (indicated by dashed lines). These fold lines, formed during the cutting of the blank by die portions which do not penetrate the material but compress same, are used to bend and fold the blank in order to create each bottom carton. The blank further contains cuts to define desired tabs and apertures and to enable elements of the blank to fold and be displaced relative to other portions to add support to the structure. These cuts are represented by numerals 43, 45, 46A and 46B, 48A and 48B, 50A and 50B and 52.

A base carton 14 is formed by pivoting the side panel 54 by 90° on the axis of fold line 34 towards the outer bottom panel 55 of the rectangular portion 22 whereby it rests perpendicular to the bottom panel. Flaps 56A and 56B which are attached to the side panel 54 are then pivoted 90° about the fold lines 36A and 36B, respectively. The flaps are thus extended perpendicularly to side panel 54 parallel to fold lines 30A and 30B. The side panel 58 is then pivoted 90° towards the outer bottom panel 55 along the axis of fold line 26 to become perpendicular to the bottom panel 55 and parallel to side panel 54. The flaps 60A and 60B which are attached to side panel 58 are then pivoted 90° towards the center about the axis of fold lines 25A and 25B, respectively, such that they are perpendicular to both the outer bottom panel 55 and side panel 58 and extend parallel to fold lines 30A and 30B.

Side panel portions 62A and 62B are then pivoted 90° about the axis of the fold lines 30*a* and 30*b*, respectively, toward the outer bottom panel 55 so as to each extend perpendicular to bottom panel 55 and parallel to tabs 56A, 56B, 60A and 60B. Side panel portions 62C and 62D of the outer bottom panel 59 are then pivoted 180° towards dual fold lines 28A and 28B so that they also extend parallel to side panel portions 62A and 62B and tabs 56A, 56B, 60A and 60B. When so positioned, tabs 64A are received in slots 68A and tabs 64B are received in slots 68B to hold the side panel portions in position. When so engaged, tabs 56A and 60A are captured between side panel portions 62A and 62C and tabs 56B and 60B are captured between side panel portions 62B and 62D, to form a strong outer portion of the bottom cartons. In lieu of engaging or capturing tabs 56A, 56B, 60A, 60B, 64A and 64B, the tabs may be glued or stapled to their respective side panels 62A, 62B, 62C and 62D to form a rigid assembly free from slippage during shipping.

The side panels 72A and 72B of the top rectangular portion 24 are then pivoted 90° towards the rectangular container receiving panel 52 about the axis of the fold lines 40A and 40B, respectively. The side panel 74 is then pivoted 90, toward the container receiving panel 52 90° about the axis of fold line 44. The entire rectangular portion 24 is then rotated 90° relative to side panel 54 towards the outer bottom panel 55 whereby the side panels **72*a* and 72*b* and are positioned on the inside of and parallel to side panel portions members 62C and 62D and side panel 74 is positioned inside of and parallel to side panel 58, thereby creating a rectangular box with apertures 76A, 76B, 78A, 78B, 80A and 80B** on the top thereof, defined by irregular rectangular cut lines.

Figure 8:
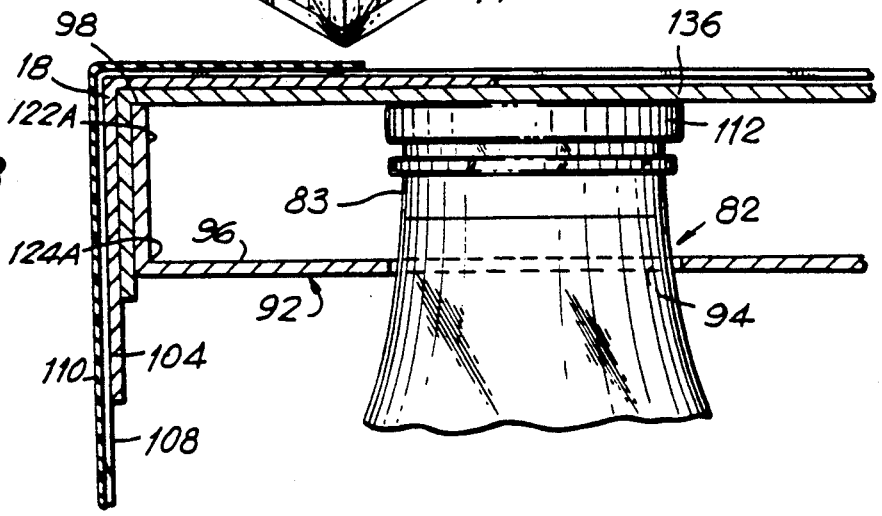
FIGS. 8 and 9 are fragmentary views taken along lines 8-8 and 9-9 of FIG. 1.
Figure 9:
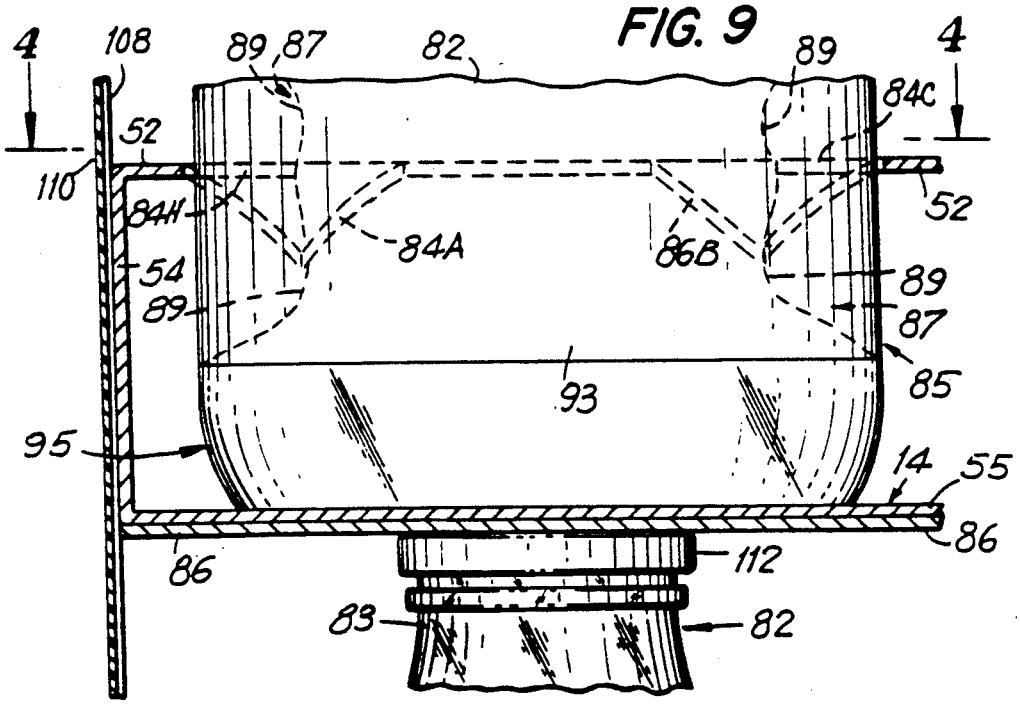

Each container 82 is a rigid glass or plastic bottle having a neck region 83 supporting a cap 112 and a wider lower region 85 (FIGS. 2, 8 and 9). The lower region 85 of each container 82 is formed with a pair of spaced vertically extending indented regions 87 defining a gripping portion or handle for the manipulation of the container during use (FIGS. 4 and 9). Each indented region 87 is formed with an undulating surface (FIG. 9) to define finger receiving recesses 89 in the indented regions. The lowermost region 95 of the container 84, below the indented region 87, is essentially a rounded rectangle in cross-section. A liquid 91 for example a juice product is contained within container 82. A suitable label 93 is provided on the side surface of the lower region of each container.

Referring to FIGS. 4–6 and 9, each of the apertures in container receiving panel 52 are provided for receiving a container 82. In the preferred embodiment, each aperture receives a bottle container 82 which is subsequently releasably retained in the aperture. Each aperture is formed with four pairs of tabs 84A, 84B, 84C, 84D, 84E, 84F, 84G and 84H, symmetrically positioned in each corner of the aperture and defined by cut lines 43 and fold lines 42, 40A and 40B. When a container 82 is inserted into an aperture (e.g. 76A), the enlarged lowermost region 95 of the container is of a large enough cross-sectional area that it must deflect downwardly tabs 84 while being inserted so as to rest on outer bottom panel 55. However, when so positioned, the tabs in registration with indented regions 87 of container 82, (tabs 84H and 84C in FIGS. 4 and 9) return to the horizontal position and serve to hold the container in the aperture. Although the indented regions are asymmetrical, the tabs 84 are symmetrical and can cooperate with a container irrespective of the rotational portion of the container in the aperture.

As shown in FIGS. 6 and 9, tabs bearing on the enlarged region 85 of container 82, out of registration with indented regions 87 are bent and bear against the side of the container to further retain it in position.

As noted above, a bottle container 82 is placed in each of the apertures **76*a* through 80*b*. In this configuration, there are six apertures, hence the base cartons 14 each carry six bottles per carton. To create the shipper display, twelve base cartons are placed on the pallet forming the first level so as to form the above described 3 × 4 array. Atop this first level is placed a corrugated board 86 as depicted in FIG. 2 and FIG. 9. The purpose of the corrugated sheet 86** is to create a smooth surface such that a new layer of base cartons can be placed upon it to create stacks of cartons, and to provide further cushioning for the tops of the containers which support the next layer. This enables the cartons to be stacked in an upward direction of four, five or six layers of bottom cartons from the pallet. Other arrays of base cartons can be used depending on the dimensions of the base carton and pallet. Also depending on the dimensions of the base carton, different arrays can be used for each layer, so that each base carton rests on the containers of more than one of the base cartons below it.

In the preferred embodiment, the base cartons are stacked to the height of five cartons as depicted in FIG. 2. The containers 82 remain separated by the construction of the shipper display during shipping. The height of the base cartons is selected to provide structural strength, to insure that some of tabs 84 are received in indented regions 87 and to insure that a substantiated portion of containers 82 and labels 93 are visible from the exterior of the shipper display. This permits packaging of several varieties (e.g. flavors) of the product in each shipper display since the contents are readily visible from all ends.

Figure 7:
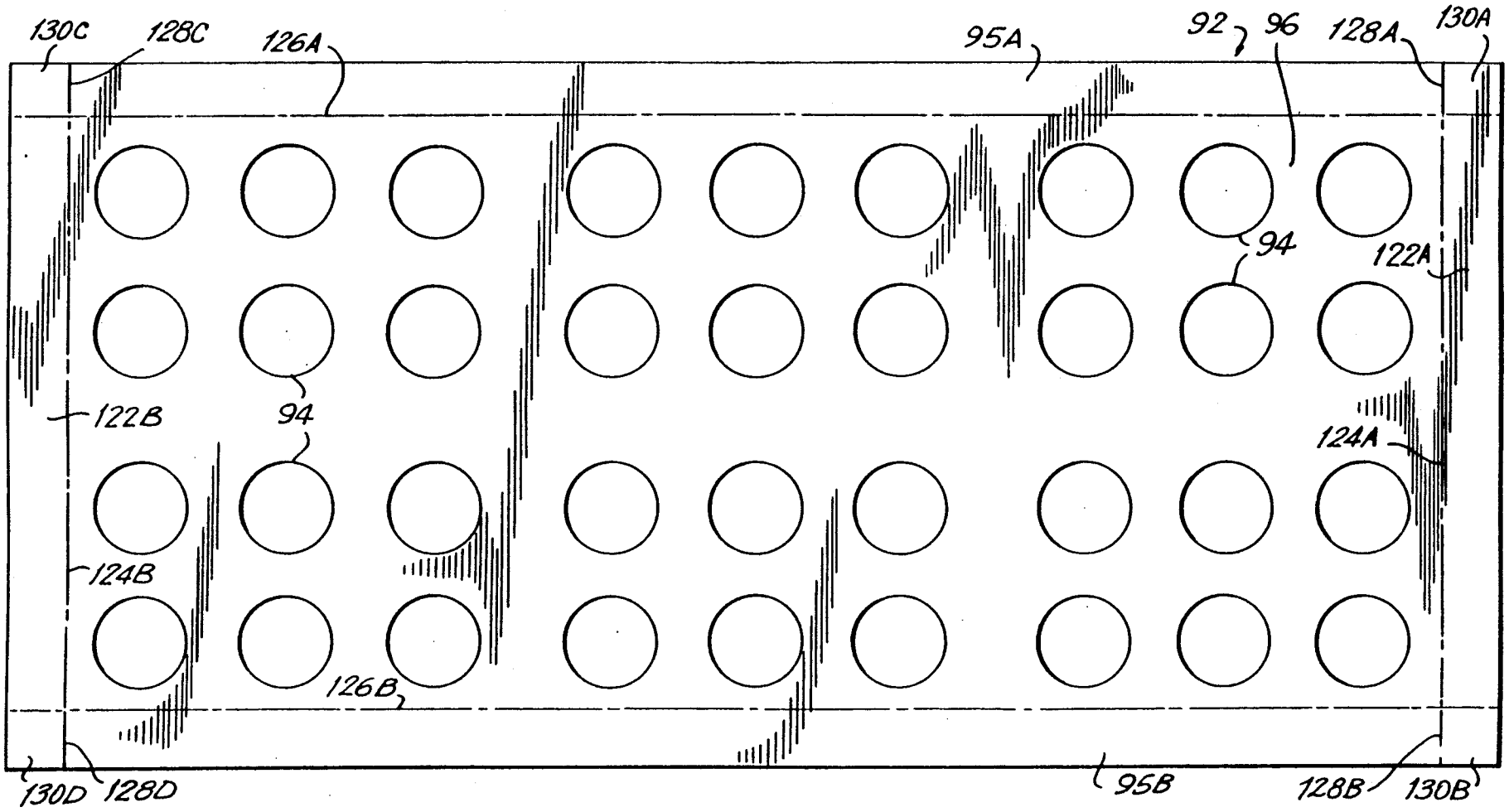
FIG. 7 is a top plan view of the sectional blank for the insert portion of the top carton.

The top layer of the shipper display 12 is a two piece top carton 18 as depicted in FIGS. 1, 7 and 8, used to cover the top level of bottles. The blank 92 for the insert section of the top carton 18 is depicted in FIG. 7. This section is constructed by four side panels 122A, 122B, 95A and 95B which are folded 90° along fold lines 124A, 124B, 126A and 126B, respectively so as to be perpendicular to the horizontally extending rectangular neck supporting region 96 of insert section 92. The neck supporting region 96 contains a plurality of apertures 94 used to receive the neck 83 of container 82.

The insert portion 92 of the top carton 18 is inserted in a lid portion 98 formed from a blank similar to blank 92 but without apertures 94 and with a slightly larger horizontally extending central panel 136 so that the insert portion is received snugly in the lid portion with panels 122A, 122B, 95A, 95B facing upwardly.

Blank 92 is formed with cut lines 128A, 128B, 128C and 128D defining tabs 130A, 130B, 130C and 130D extending from both sides of panels 122A and 122B and rotated 90° relative thereto along the axis defined by extensions of fold lines 126A and 126B. Tabs 130A and 130C are secured to panels 122A and 122B, respectively, by adhesive or staples, as are tabs 130B and 130D, to define the insert portion.

The relation between the lid and insert portions of top carton 18 is shown in FIG. 8. The insert portion is depicted with its side walls pointing in an upward direction. The lid portion receives the insert portion as shown. When mounted on the top layer of containers, the central panel 136 of the lid portion of the top carton 18 rests atop caps 112 of containers 82. This position hinders the upward movement of the bottles during shipping. The apertures 94 of the insert portion engage the necks of the containers, providing further stability to the shipper display.

Figure 10:
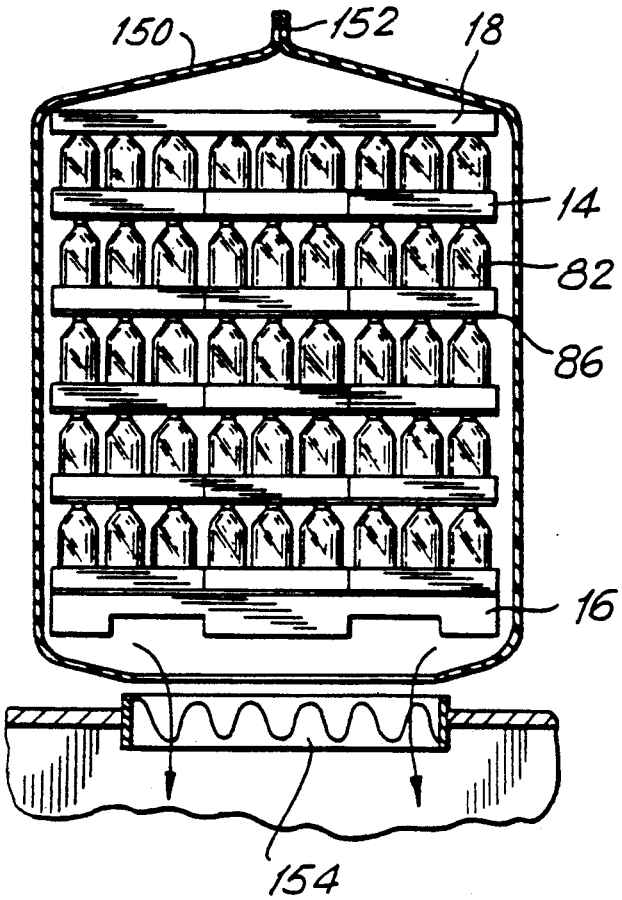
FIG. 10 is a partially sectional view of an alternative embodiment of the shipper display in accordance with the invention with shrink bag in position over a loaded pallet above a suction mechanism.
Figure 11:
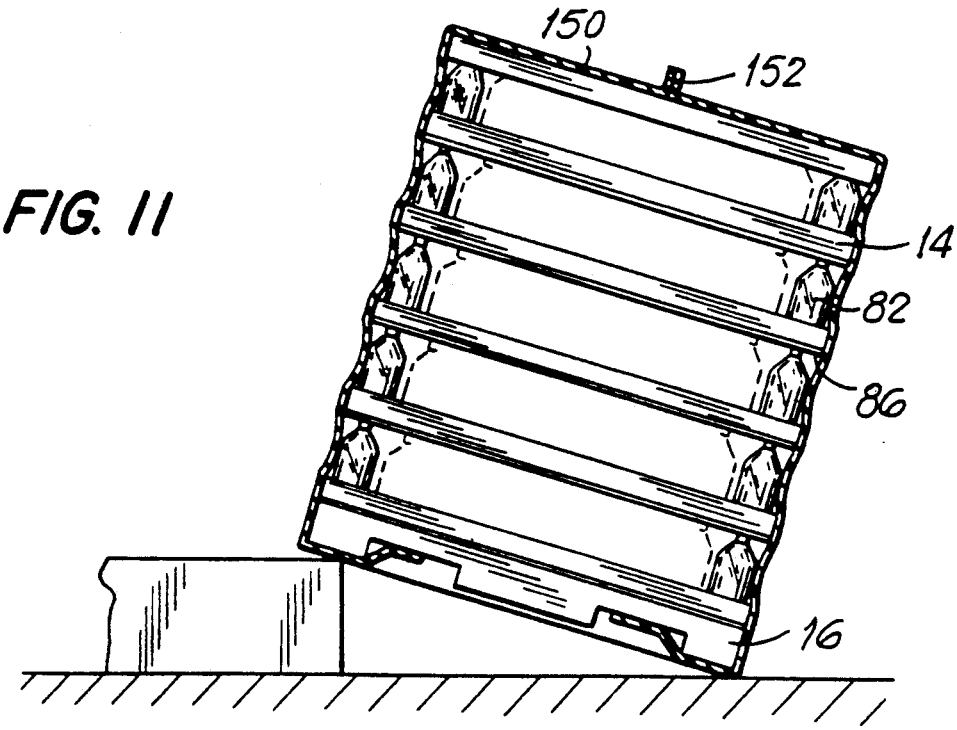
FIG. 11 is a side elevational view of the shrink bag embodiment of the shipper display in the shipping configuration, inclined at an angle to show the structural integrity of the construction.

Referring now to FIGS. 10 and 11, an alternative embodiment is shown for the shipper display in accordance with the invention. Shrink bag 150 is manufactured from a tube of plastic film heat sealed at point 152 to form a bag configuration. Then, shrink bag 150 is applied over the pallet as shown in FIG. 10 either manually or by automation. Pallet 16 is supported over suction or vacuum means 154 such that when the machine is operating it forces the ends of shrink bag 150 to slide under pallet 16, allowing the lower ends of shrink bag 150 to fold under the lower edges of pallet 16. Next, a heat shrinking unit such as a MSK-290 Safety Shrink, manufactured by MSK Covertech Inc. and designed to essentially surround a portion of the height of the bag, is applied from the bottom up. This causes the shrink bag 150 to shrink to fit tightly about the shipper display including containers 82, bottom cartons 14, top cartons 18 and corrugated sheets 86 as shown in FIG. 11. Further, the lower end of shrink bag 150 extends under and captures pallet 16, leaving the underneath center region of pallet 16 uncovered by shrink bag 150. Shrink bag 150 holds the entire configuration in a vertical compression so that internal shifting of the pallet does not occur even when shipper display is tilted up to a 30° angle. This construction does not require top and side corner protectors 104, 106 or strapping material 108.

It will thus be seen that the objects set forth above, and those made apparent from the preceding description, are efficiently attained and, since certain changes may be made in the above construction without departing from the spirit and scope of the invention, it is intended that all matters contained in the above description or shown in the accompanying drawings shall be interpreted as illustrative and not in a limiting sense.

It is also to be understood that the following claims ar intended to cover all of the generic and specific features of the invention herein described, and all statements of the scope of the invention which, as a matter of language, might be said to fall therebetween.

What is claimed is:

1. A shipper display for rigid containers comprising a plurality of base cartons each receiving a plurality of said containers, each said base carton having an essentially flat bottom panel means adapted to support the containers received therein, said base cartons including a plurality of holding means for positioning said containers in spaced relation across said bottom panel means, said base cartons being of a height less than the height of the containers, at least a portion of said base cartons carrying said containers being stacked one upon the other so that a plurality of said base cartons forms a layer of said stack free of an additional peripheral rim beyond that of each base carton; a unitary sheet between each of said stacks of said array of said base cartons, with the bottom panel means of the base cartons other than the lowermost base carton being supported by said unitary sheet which is in turn at least substantially supported by the tops of the containers carried by the base cartons below it in the stack said peripheral sheets being free of a peripheral rim and apertures or recesses in registration with the tops of the containers carried by the base cartons below it in the stack; at least one top carton coupled to the tops of the uppermost of at least a portion of the containers in the upper most carton in the stack; and means for releasably retaining the stack as a unit for shipment, whereby the stack is suitable for display upon release of said retaining means and removal of said top carton.

2. A shipper display as claimed in claim 1, and including a pallet supporting the lowermost of the stack of base cartons and retained by said retaining means to said stack for shipment.

3. A shipper display as claimed in claim 2, wherein said pallet is constructed of wood.

4. A shipper display as claimed in claim 2, wherein said pallet is dimensioned to support said array of said base cartons forming said stacks, said retaining means releasably retaining said stacks and pallet as a unit for shipping.

5. A shipper display as claimed in claim 4, wherein said at least one top carton is adapted to overlie and couple with the tops of the containers in the uppermost base carton of at least two adjacent stacks.

6. A shipper display as claimed in claim 5, and including at least two top cartons which together overlie and couple with the tops of the containers of all of the containers in the uppermost layer of said stacks of base cartons.

7. A shipper display as claimed in claim 6, wherein said stacks of base cartons are aligned in a 3 X 4 configuration of base cartons on said pallet.

8. A shipper display as claimed in claim 7, wherein said base cartons are stacked five high.

9. A shipper display as claimed in claim 4, wherein said unitary sheet is a board means intermediate the bottom panel means of at least the base cartons other than the lowermost base cartons in the stacks and the adjacent tops of the containers immediately below in the stack.

10. A shipper display as claimed in claim 9, wherein the board means are formed of corrugated board.

11. A shipper display as claimed in claim 1, wherein said at least one top carton includes a top panel means for engaging the tops of the containers to which it is coupled and a coupling panel means spaced from said top panel means and formed with apertures therethrough for passage of the tops of the containers to the top panel means for relative positioning of the containers and top carton.

12. A shipper display as claimed in claim 11, wherein said at least one top carton comprises a cover portion incorporating said top panel means and including a downwardly extending peripheral rim, and a separate insert portion incorporating said coupling panel means and including an upwardly extending peripheral rim coupled with the peripheral rim of the associated cover portion.

13. A shipper display as claimed in claim 4 and including corner protection means positioned along the vertical edges of the unit defined by the assembled stacks of bottom cartons retained by said retaining means and removable for display.

14. A shipper display as claimed in claim 13, and including additional corner protection means positioned along the vertical edges of the top of the unit defined by the assembled stack, said additional corner protection means being retained by the retaining means and removable for display.

15. A shipper display as claimed in claim 4, wherein said retaining means includes strap means.

16. A shipper display as claimed in claim 4, wherein said retaining means includes stretch wrap means surrounding at least the sides of the unit defined by said stacks of bottom carton means.

17. A shipper display for rigid containers comprising a plurality of base cartons each receiving a plurality of said containers, each said base carton having an essentially flat bottom panel means adapted to support the containers received therein, said base cartons including a plurality of holding means for positioning said containers in spaced relation across said bottom panel means, said base cartons being of a height less than the height of the containers, at least a portion of said base cartons carrying said containers being stacked one upon the other with the bottom panel means of the base cartons other than the lowermost base carton being at least substantially supported by the tops of the containers carried by the base carton below it in the stack; at least one top carton coupled to the tops of the uppermost of at least a portion of the containers in the uppermost carton in the stack; and means for releasably retaining the stack as a unit for shipment, whereby the stack is suitable for display upon release of said retaining means and removal of said top carton, including a pallet supporting the lowermost of the stack of said base cartons and retained by said retaining means to said stack for shipment and including a pallet base wrap means retained by said retaining means during shipping and adapted to be engaged along the periphery of the pallet.

18. A shipper display as claimed in claim 17, wherein said pallet base wrap means includes decorative and/or informative material thereon to make the shipper display more attractive in the display mode.

19. A shipper display as claimed in claim 1, wherein said base carton holding means comprises a container receiving panel spaced from said flat bottom panel and formed with a plurality of apertures therethrough, each of said apertures being shaped to receive a container, said container receiving panel being formed with tab means projecting into each of said apertures for displacement by a container when inserted through the aperture into engagement with the flat bottom panel, at least a portion of the tab means bearing on the container for positioning and retaining the container during shipping and display.

20. A shipper display as claimed in claim 19, wherein each said aperture is essentially rectangular, said tab means comprising a pair of tabs projecting into each corner of the essentially rectangular aperture, each pair of tabs being separated by a cut line extending from the region of a corner of the rectangle defined by the aperture in essentially diagonal direction.

21. A shipper display for rigid containers comprising a plurality of base cartons each receiving a plurality of said containers, each said base carton having an essentially flat bottom panel means adapted to support the containers received therein, said base cartons including a plurality of holding means for positioning said containers in spaced relation across said bottom panel means, said base carton holding means comprising a container receiving panel spaced from said flat bottom panel and formed with a plurality of apertures therethrough, each of said apertures being shaped to receive a container, said container receiving panel being formed with tab means projecting into each of said apertures for displacement by a container when inserted through the apertures into engagement with the flat bottom panel, at least a portion of the tab means bearing on the container for positioning and retaining the container during shipping and display, each said aperture being essentially rectangular, said tab means comprising a pair of tabs projecting into each corner of the essentially rectangular aperture, each pair of tabs being separated by a cut line extending form the region of a corner of the rectangle defined by the aperture in essentially a diagonal direction, said container being formed with a pair of vertically extending spaced indented regions terminating above the bottom of the container, the spacing between the flat bottom panel and the container receiving panel being selected so that when a container is inserted through an aperture, at least one of the tabs is in registration with an indented region of the container and returns to a position essentially parallel to the principal portion of the container receiving panel when the container rests on the flat bottom panel to aid in retaining the container int he aperture, said base cartons being of a height less than the height of the containers, at least a portion of said base cartons carrying said containers being stacked one upon the other with the bottom panel means of the base cartons other than the lowermost base carton being at least substantially supported by the tops of the containers carried by the base carton below it in the stack; at least one top carton coupled to the tops of the uppermost of at least a portion of the containers in the uppermost carton in the stack; and means for releasably retaining the stack as a unit for shipment, whereby the stack is suitable for display upon release of said retaining means and removal of said top carton.

22. A shipper display for rigid containers comprising a plurality of base cartons each receiving a plurality of said containers, each said base carton having an essentially flat bottom panel means adapted to support the containers received therein, said base cartons including a plurality of holding means for positioning said containers in spaced relation across said bottom panel means, said base carton holding means comprising a container receiving panel spaced from said flat bottom panel and formed with a plurality of apertures therethrough, each of said apertures being shaped to receive a container, said container receiving panel being formed with tab means projecting into each of said apertures for displacement by a container when inserted through the apertures into engagement with the flat bottom panel, at least a portion of the tab means bearing on the container for positioning and retaining the container during shipping and display, said tab means including a plurality of tabs, at least a portion of the tabs being positioned to be engaged by the container during insertion through the aperture to the position of rest on the flat bottom panel to pivotably displace at least a portion of the tabs towards the flat bottom panel to a position at which they bear on the container for positioning and retaining the container during shipping and display, said container being formed with at least one vertically extending spaced indented region terminating above the bottom of the container, the spacing between the bottom panel and the container receiving panel being selected so that when a container is inserted through an aperture, at least one of the tabs is in registration with an indented region of the container and returns to a position essentially parallel to the principal portion of the container receiving panel when the container rests on the flat bottom panel to further aid in retaining the container int he aperture, said base cartons being of a height less than the height of the containers, at least a portion of said base cartons carrying said containers being stacked one upon the other with the bottom panel means of the base cartons other than the lowermost base carton being at least substantially supported by the tops of the containers carried by the base carton below it in the stack; at least one top carton coupled to the tops of the uppermost of at least a portion of the containers in the uppermost carton in the stack; and means for releasably retaining the stack as a unit for shipment, whereby the stack is suitable for display upon release of said retaining means and removal of said top carton.

23. A shipper display as claimed in claim 22, wherein the tabs are oriented about the periphery of the aperture so that at least one tab is in registration with an indented region at each of the plurality of orientations of the container in the aperture.

24. A shipper display as claimed in claim 19, wherein said base carton is formed from a unitary blank having fold and cut lines therein, said blank including said flat bottom panel and container receiving panel joined through fold lines by a side panel, each of said flat bottom panel and container receiving panel also each being joined to further side panels and tabs to provide a load-bearing box structure.

25. A shipper display as claimed in claim 1, wherein said containers include labels, each said base carton being of a height sufficiently less than the height of the container to expose to view when displayed a substantial portion of the height of the container, including at least a portion of the label.

26. A shipper display as claimed in claim 4, wherein said retaining means is formed of a plastic retaining member shrunk to engage at least the side periphery of said assembled top and base cartons and pallet and at least the peripheral regions of the top of the top cartons and the bottom of the pallet.

27. A shipper display as claimed in claim 26, wherein the plastic retaining member is in the form of a shrink bag sealed at the top region thereof to overlie the top surface of the top cartons.

28. A base carton for shipping and displaying containers comprising an essentially flat bottom panel means adapted to support containers received therein, and a container receiving panel spaced from said flat bottom panel and formed with a plurality of apertures therethrough each dimensioned to permit a container to pass therethrough so that the bottom of the container rests against and is supported by the flat bottom panel, said base carton being formed from a unitary blank having fold and cut liens therein, said blank including said flat bottom panel and container receiving panel joined through fold lines by a side panel, each of said flat bottom panel and container receiving panel also each being joined to further side panels and tabs coupled to said side panels to provide a load-bearing box structure so that when said unitary blank is folded to form said base carton, said base carton is firmly supported on the top and bottom by said container receiving panel and said flat bottom panel respectively and firmly supported on four side walls by said side panels, said container receiving panel being formed with tab means projecting into each of said apertures for displacement by a container when inserted through the aperture into engagement with the flat bottom panel, said base carton being of a height less than the height of the container to expose a substantial portion of the container to view while positioning the containers in spaced relation.

29. A base carton as claimed in claim 28, wherein at least a portion of the tab means bears on the container for positioning and retaining the container during shipping and display.

30. A base carton as claimed in claim 29, wherein each said aperture is essentially rectangular, said tab means comprising a pair of tabs projecting into each corner of the essentially rectangular aperture, each pair of tabs being separated by a cut line extending form the region of a corner of the rectangle defined by the aperture in essentially a diagonal direction.

31. A base carton for shipping and displaying containers comprising an essentially flat bottom panel means adapted to support containers received therein, a container receiving panel spaced from said flat bottom panel and formed with a plurality of apertures therethrough each dimensioned to permit a container to pass therethrough so that the bottom of the container rests against and is supported by the flat bottom panel, said container receiving panel being formed with tab mean projecting into each of said apertures for displacement by a container when inserted through the aperture into engagement with the flat bottom panel, at least a portion of the tab means bearing on the container for positioning and retaining the container during shipping and display, said container is formed with a pair of vertically extending spaced indented regions terminating above the bottom of the container, the spacing between the flat bottom panel and the container receiving panel being selected so that when a container is inserted through an aperture, at least one of the tabs is in registration with an indented region of the container and returns to a position essentially parallel to the principal portion of the container receiving panel when the container rests on the flat bottom panel to aid in retaining the container in the aperture.

32. A base carton for shipping and displaying containers comprising an essentially flat bottom panel means adapted to support containers received therein, a container receiving panel spaced from said flat bottom panel and formed with a plurality of apertures therethrough each dimensioned to permit a container to pass therethrough so that the bottom of the container rests against and is supported by the flat bottom panel, said container receiving panel being formed with tab mean projecting into each of said apertures for displacement by a container when inserted through the aperture into engagement with the flat bottom panel, at least a portion of the tab means bearing on the container for positioning and retaining the container during shipping and display, said tab means including a plurality of tabs, at least a portion of the tabs being positioned to be engaged by the container during insertion through the aperture to the position of rest on the flat bottom panel to pivotably displace at least a portion of the tabs towards the flat bottom panel to a position at which they bear on the container for positioning and retaining the container during shipping and display, said container being formed with at least one vertically extending spaced indented region terminating above the bottom of the container, the spacing between the bottom panel and the container receiving panel being selected so that when a container is inserted through an aperture, at least one of the tabs is in registration with an indented region of the container and returns to a position essentially parallel to the principal portion of the container receiving panel when the container rests on the flat bottom panel to further aid in retaining the container in the aperture.

33. A base carton as claimed in claim 32, wherein the tabs are oriented about the periphery of the aperture so that at least one tab is in registration with an indented region at each of the plurality of orientations of the container int he aperture.

34. A base carton as claimed in claim 31, wherein said base carton is formed from a unitary blank having fold and cut lines therein, said blank including said flat bottom panel and container receiving panel joined through fold lines by a side panel, each of said flat bottom panel and container receiving panel also each being joined to further side panels and tabs to provide a load-bearing box structure.

35. A base carton as claimed in claim 31, wherein said base carton is formed from a unitary blank having fold and cut lines therein, said blank including said flat bottom panel and container receiving panel joined through fold lines by a side panel, each of said flat bottom panel and container receiving panel also each being joined t further side panels and tabs glued to said side panels to provide a load-bearing box structure.

36. A base carton as claimed in claim 31, wherein said containers include labels, each said base carton being of a height sufficiently less than the height of the container to expose to view when displayed a substantial portion of the height of the container, including at least a portion of the label.

* * * * *